US005443420A

United States Patent [19]

Kim et al.

[11] Patent Number: 5,443,420

[45] Date of Patent: Aug. 22, 1995

[54] AIR FLOW DIRECTION CONTROL APPARATUS AND THE METHOD THEREOF

[75] Inventors: Dong J. Kim, Incheon; Duk J. Yang, Suwon, both of Rep. of Korea

[73] Assignee: Samsung Electronics Co., Ltd., Suwon, Rep. of Korea

[21] Appl. No.: 225,400

[22] Filed: Apr. 8, 1994

[30] Foreign Application Priority Data

Jun. 18, 1993 [KR] Rep. of Korea ..... 1993-11192
Jul. 13, 1993 [KR] Rep. of Korea ..... 1993-12847

[51] Int. Cl.[6] ..... F24F 13/15

[52] U.S. Cl. ..... 454/256; 251/129.01; 251/229; 251/250; 454/258; 454/313; 454/318; 454/319

[58] Field of Search ..... 454/202, 313, 314, 316, 454/319, 320, 321, 256, 258, 325, 326, 335, 336, 318; 251/129.01, 229, 250

[56] References Cited

U.S. PATENT DOCUMENTS 2,997,938 8/1961 Sievert et al. ..... 454/328

FOREIGN PATENT DOCUMENTS 109741 6/1984 Japan ..... 454/313
62-123248 6/1987 Japan .
118549 5/1988 Japan ..... 454/256
179857 7/1989 Japan ..... 454/313

*Primary Examiner*—Harold Joyce
*Attorney, Agent, or Firm*—Burns, Doane, Swecker & Mathis

[57] ABSTRACT

The direction of air flow in an air blower is controlled by a plurality of rotationally adjustable blades (vanes) extending across an air flow passage. A motor is connected to the blades for rotating the blades between passage-opening and passage-closing positions and intermediate positions therebetween. A sensor senses the angular position of the blades and supplies a signal to a controller which compares that signal to a signal representative of a selected angular position of the blades. If the blades become-displaced by a force independent of the motor, the sensor signals the controller of such displacement, whereupon the motor is actuated to return the blades to the selected position.

4 Claims, 10 Drawing Sheets

AIR FLOW DIRECTION CONTROL APPARATUS AND THE METHOD THEREOF

BACKGROUND OF THE INVENTION

1. Field of the Invention

The present invention is related to an air flow direction control apparatus, and particularly to an air flow direction control apparatus and method for rotating blades which determines the discharge direction of treated air to a desired position in spite of the application of an undesirable external force or mechanical defect thereof.

2. Description of the Prior Art

Recently, an air conditioning apparatus has been developed to apply fuzzy theory or neuro-fuzzy theory, in which the amount of air to be treated is varied according to various room condition data and the rotation angle of the blades for determining the discharge direction of the treated air is automatically controlled, thereby optimally operating the apparatus.

In the conventional air conditioning apparatus, a system controller operates a cooled (or heated) air generating device so that the appropriate amount of air, as determined according to the various room condition data, may be generated. The cooled (or heated) air thus generated is guided by the blades and then discharged from the apparatus.

A stepping motor, which can precisely control the rotation angle, may be preferably used as the means for rotating the blades.

FIG. 1 is a perspective view of a conventional air conditioner in which the indoor unit is designed to be physically separated from the outdoor unit.

Referring to FIG. 1, a conventional air conditioner generally comprises a main housing 10, an air suction portion 20 for inhaling air to be heat-exchanged, and an air discharge portion 30 for discharging the heat-exchanged air from the apparatus.

The air suction portion 20 is ordinarily disposed in the lower portion of the main housing 10, and the air discharge portion 30 is ordinarily disposed in the upper portion of the main housing 10. Several blades, which are designed to move simultaneously, are disposed at equal intervals internal to the air discharge portion 30.

On the other hand, a conventional air flow direction control apparatus comprises a mechanism, that, despite the application of an undesirable external force to the blades, prevents the transmission of the external force to the axis of the motor which rotates the blades, and restores the blades to their intended position upon the removal of the external force.

FIG. 2 is an exploded perspective view of a conventional air flow direction control apparatus, and FIGS. 3 and 4 are sectional views of a conventional air flow direction control apparatus in the closed and opened states, respectively, of the blades thereof.

Referring to FIGS. 2 through 4, as a motor 51 operates, a crank arm 54, which is provided in a slide perforation 53 of a link 52, is rotated. A first slide member 56 and a second slide member 57 are provided on the upper and lower part of the crank arm 54, respectively. The first and second slide member 56 and 57 are connected to each other by a resilient member 55 in order to achieve a rectilinear movement with the simultaneous movement of the link 52. The rectilinear movement of the link 52 rotates shafts 59 which are connected to blades 58, so that the blades 58 move within a predetermined range. When an undesirable external force is applied in one direction to the blades 58, the shaft 59 is rotated thereby and the link 52 is moved in the direction of arrow "A" as shown in FIG. 4. Protrusions 60, which are provided adjacent both sides of the crank arm 54 and integrally connected to the link 52, push the second slide member 57 in the direction of arrow "A". Hence, the first slide member 56 placed on the upper portion of the crank arm 54 remains in a fixed position and the resilient member 55 is extended. Consequently, the external force applied to the blades 58 is not transmitted to the crank arm 54, thereby preventing the movement of the motor 51 from being interrupted. Further, when the external force is no longer applied, the link 52 is moved upward by the restoring force of the resilient member 55. The blades 58 then return to the intended position.

However, the afore-mentioned conventional air flow direction control apparatus has many problems in that the whole structure is complicated and occupies a significant amount of space. Because of the excessive number of parts required, the assembly efficiency is low and the production costs are high.

Furthermore, the blades can not be restored to the exact position at which the blades were placed prior to the application of the external force due to a defect in the resilient member.

Another air flow direction control apparatus is disclosed in Japanese Patent Laid-Open Sho 62-123248 (1987). However, the apparatus according to the Japanese official gazette is merely for positioning the blade at a specified position simultaneously with the stopping of the operation of the air conditioner, not for restoring the rotation angle of the blade, after it is changed by an undesirable external force, to the intended position prior to the application of the external force.

SUMMARY OF THE INVENTION

It is an object of the present invention to provide an air flow direction control apparatus and method for exactly controlling the rotation angle of the blades for determining the discharge direction of the treated air, thereby increasing the efficiency of the air conditioning system.

It is another object of the present invention to provide an air flow direction control apparatus and method for automatically restoring the blades for determining the discharge direction of the treated air, even when the rotation angle of the blades is changed by an undesirable external force, to the desired angle, thereby increasing the efficiency of the air conditioning system.

It is still another object of the present invention to provide a simplified air flow direction control apparatus, and which occupies less space and requires fewer parts, thereby increasing the efficiency of the air conditioning system and lowering production costs.

In order to achieve these objects, an air flow direction control apparatus of the present invention comprises a plurality of blade members for determining the discharge direction of the air; means for providing driving force for rotating the blade members; means for sensing the rotation angle of the blade members; and, means for discerning the current rotation angle of the blade members based on a signal from the angle sensing means, and for controlling the driving force providing means in order that the blade members may be rotated to a desired angle.

In the apparatus having the afore-mentioned configuration, the driving force providing means comprises means for generating rotative driving force; first driving force converting means for changing the rotative driving force to rectilinear driving force; and, second driving force converting means for changing the rectilinear driving force to rotative driving force for rotating the blade members.

In more detail, the rotative driving force generating means comprises a motor having a pinion coupled to the axis thereof. The first driving force converting means comprises a sliding member having two racks formed on the inner and outer surfaces thereof, and the outer rack is tooth-coupled to the pinion. The second driving force converting means comprises a plurality of pinions coupled to the shaft of the blade members and tooth-coupled to the inner rack, respectively.

Furthermore, in the afore-mentioned apparatus, the angle sensing means comprises a variable resister of which resistance is varied in proportion to the rotation angle of the blade members.

On the other hand, an air flow direction control method is preferably applied to an air conditioning system or heating system which is adapted to rotate a plurality of blade members for determining the discharge direction of air to a commanded rotation angle by sensing the current rotation angle of the blade members per a specified time interval. The method comprises the steps of determining whether or not the system is in operation; and, restoring the blade members to the commanded rotation angle, when the system is in operation and the rotation angle of the blade members is varied without another command for changing the rotation angle.

In the method described above, the rotation angle of the blade members is sensed on the basis of the resistance varied in proportion to the rotation angle.

BRIEF DESCRIPTION OF THE DRAWINGS

These and other aspects of the present invention are clarified in the accompanying drawings in which.

DETAILED DESCRIPTION OF THE PREFERRED EMBODIMENTS

Hereinafter, the preferred embodiments according to the present invention will be described in detail in reference to the accompanying drawings.

Figure 1:
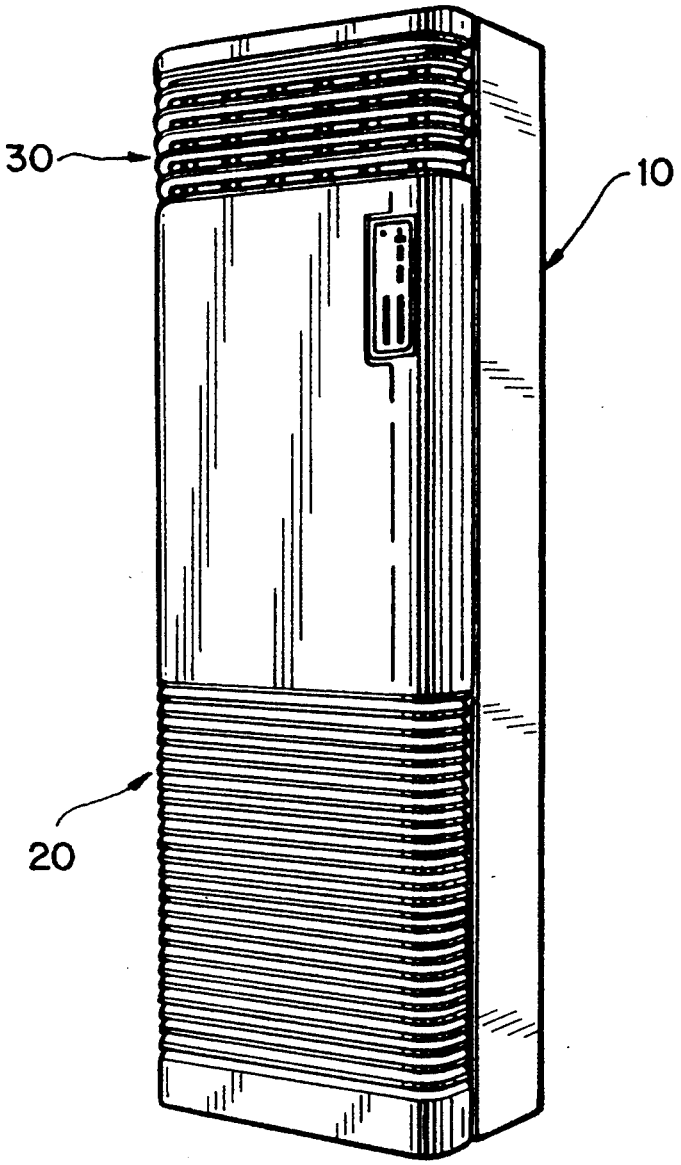
FIG. 1 (PRIOR ART)
FIG. 1 is a perspective view of a conventional air conditioner.
Figure 2:
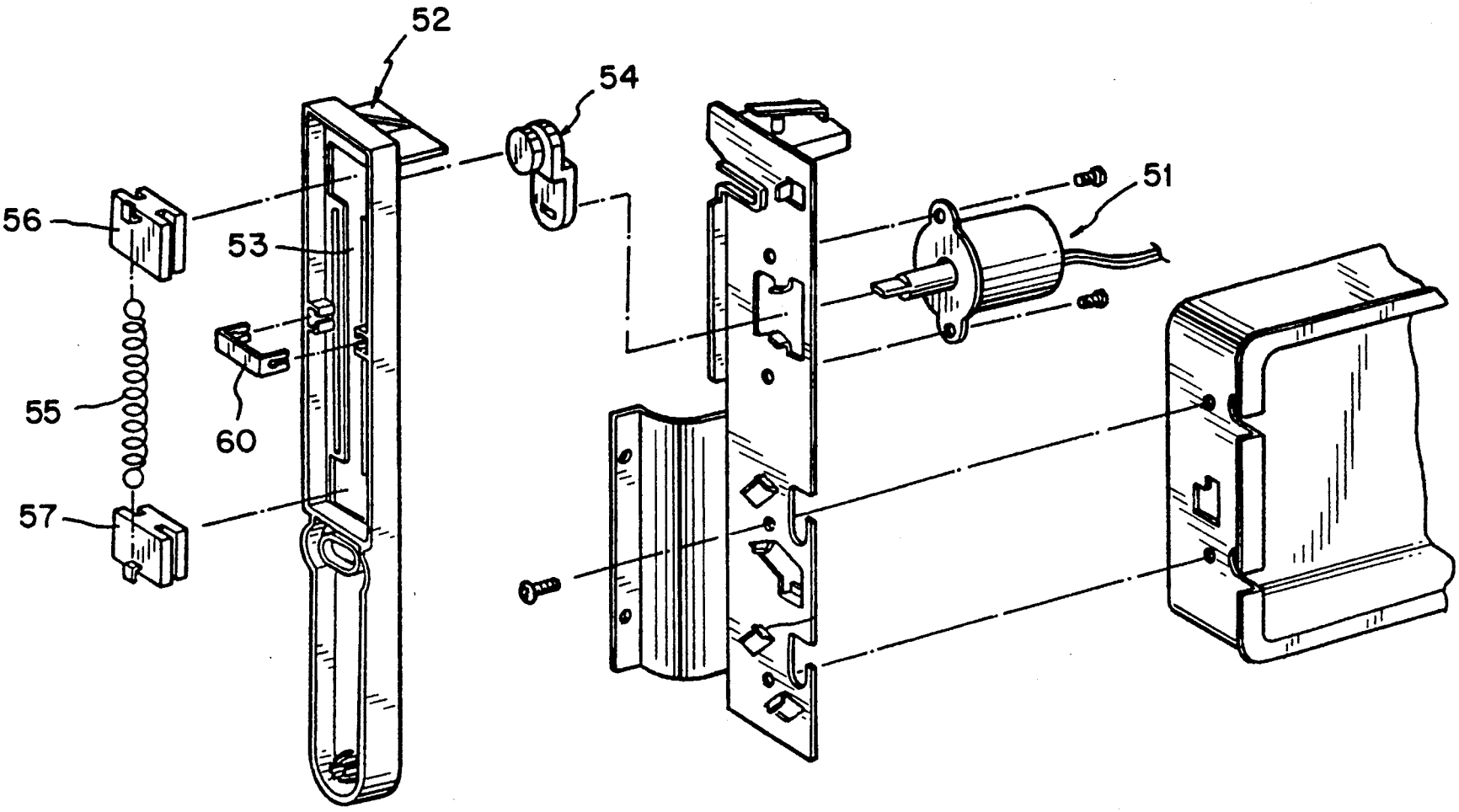
FIG. 2 (PRIOR ART)
FIG. 2 is an exploded perspective view of a conventional air flow direction control apparatus of a conventional air conditioner.
Figure 3:
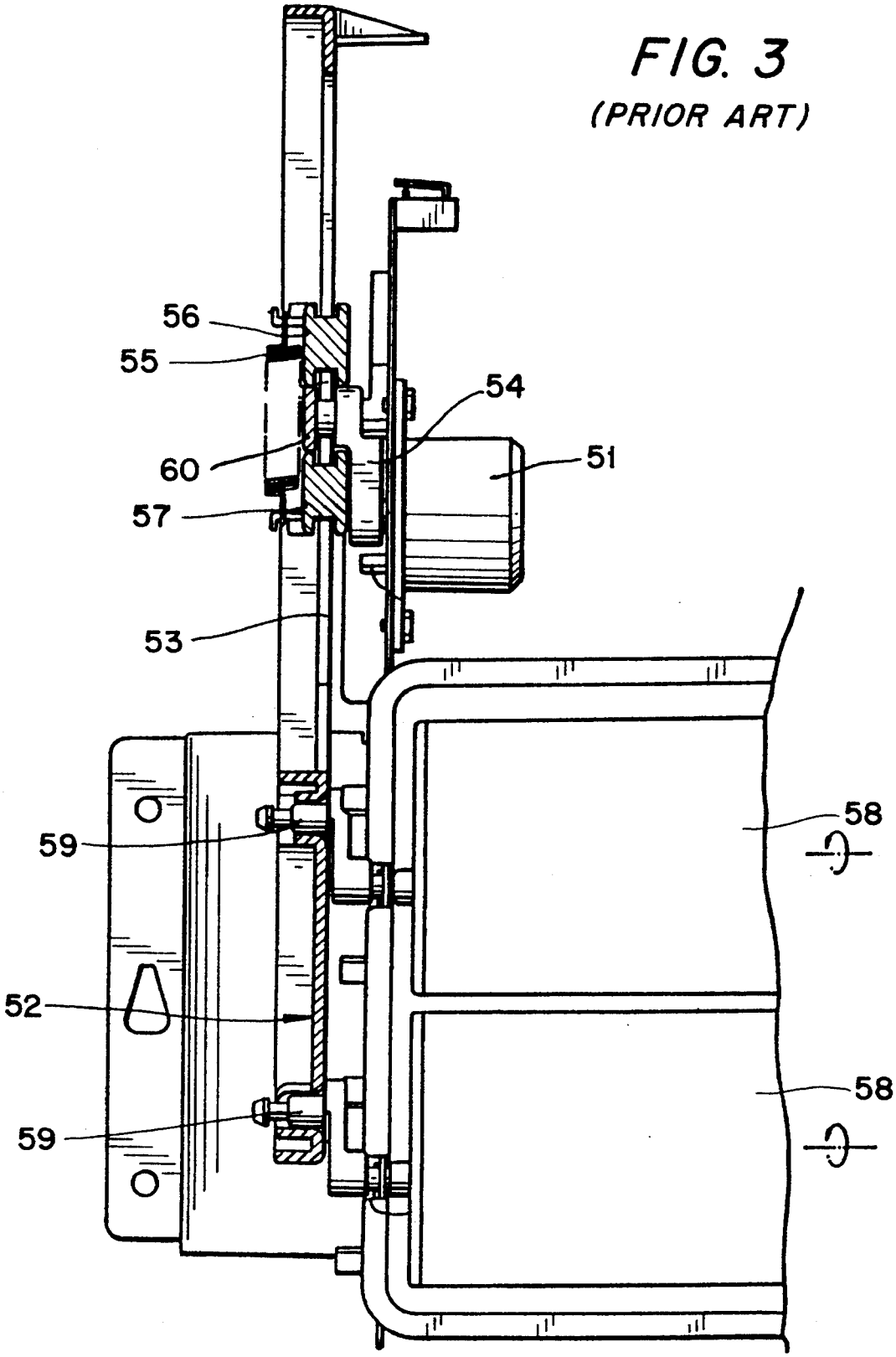
FIG. 3 (PRIOR ART)
FIGS. 3 and 4 are sectional views of a conventional air flow direction control apparatus in the closed and opened states respectively of the blades thereof.
Figure 4:
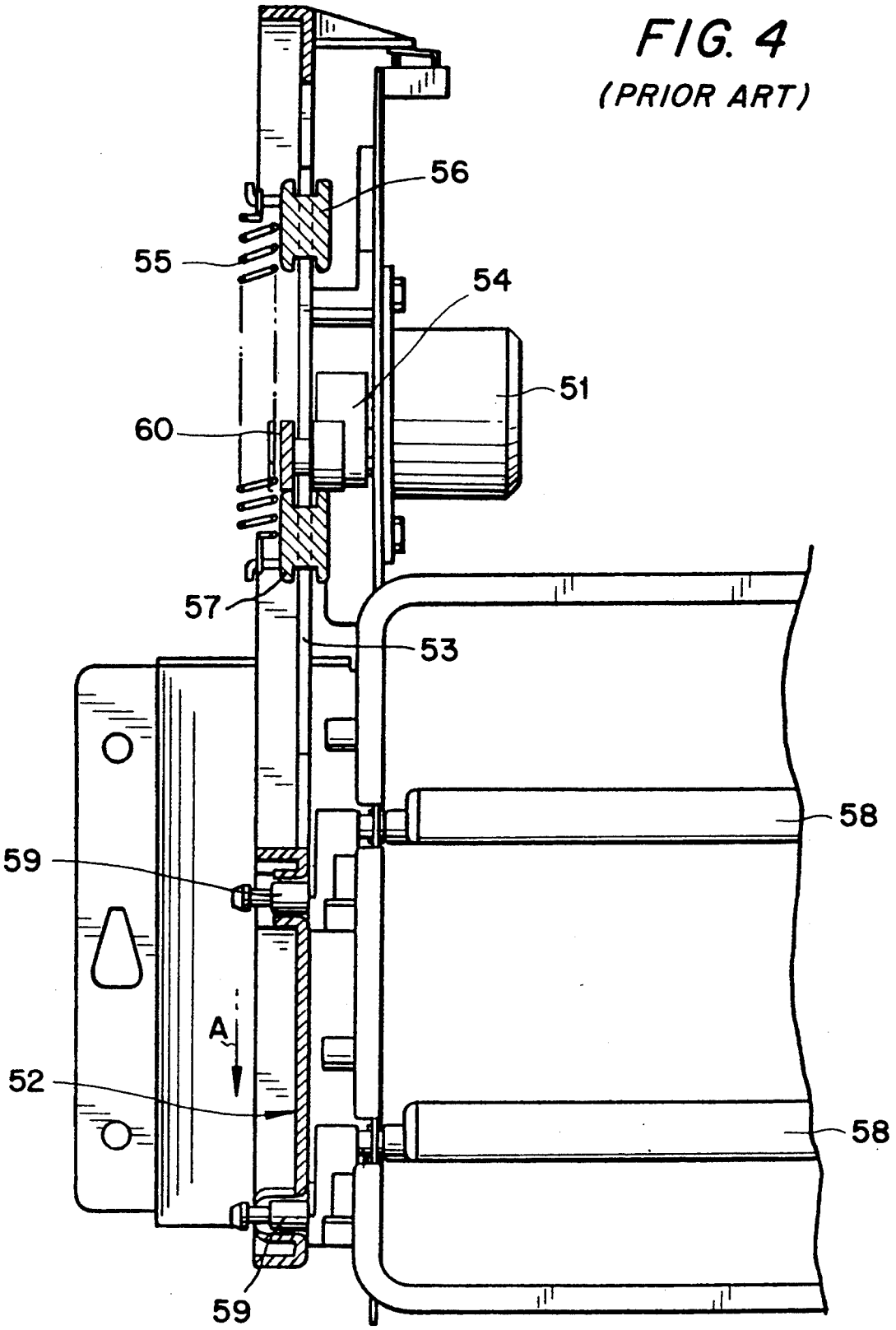
FIG. 4 (PRIOR ART)
Figure 5:
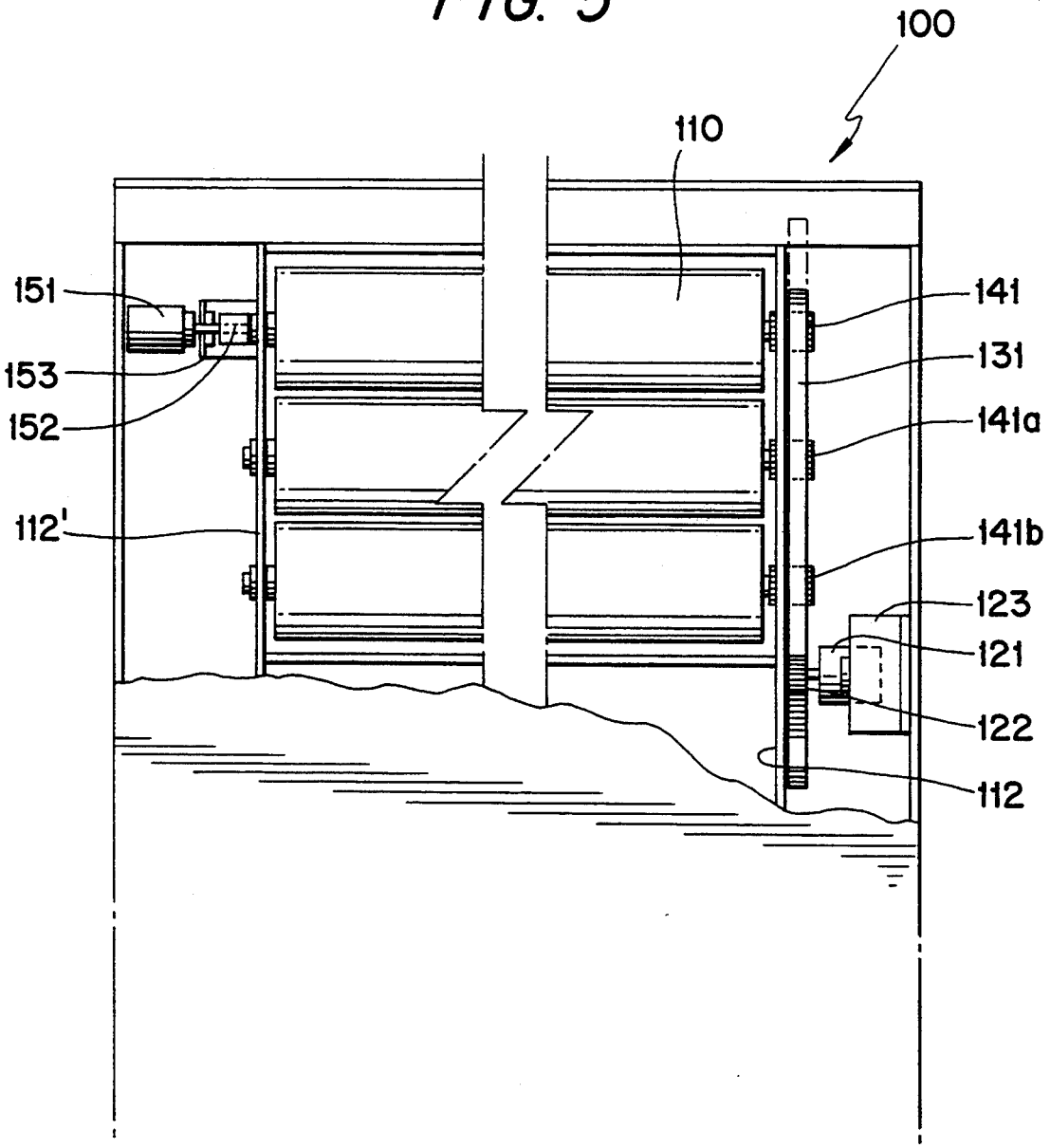
FIG. 5 is a front view showing an air flow direction control apparatus according to the present invention.
Figure 6A:
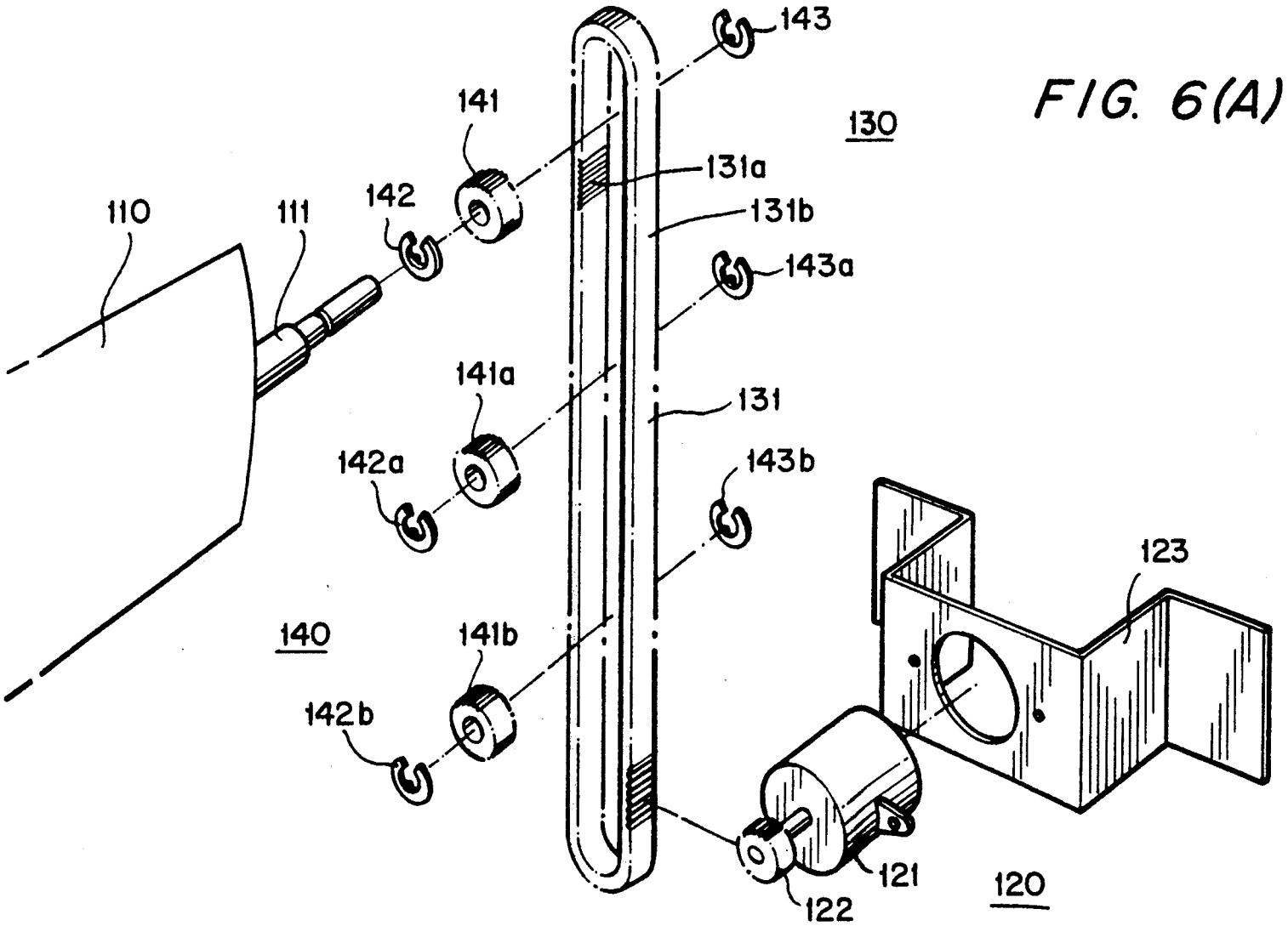
FIGS. 6 (A) and (B) are exploded perspective views of respective portions of an air flow direction control apparatus according to the present invention.
Figure 6B:
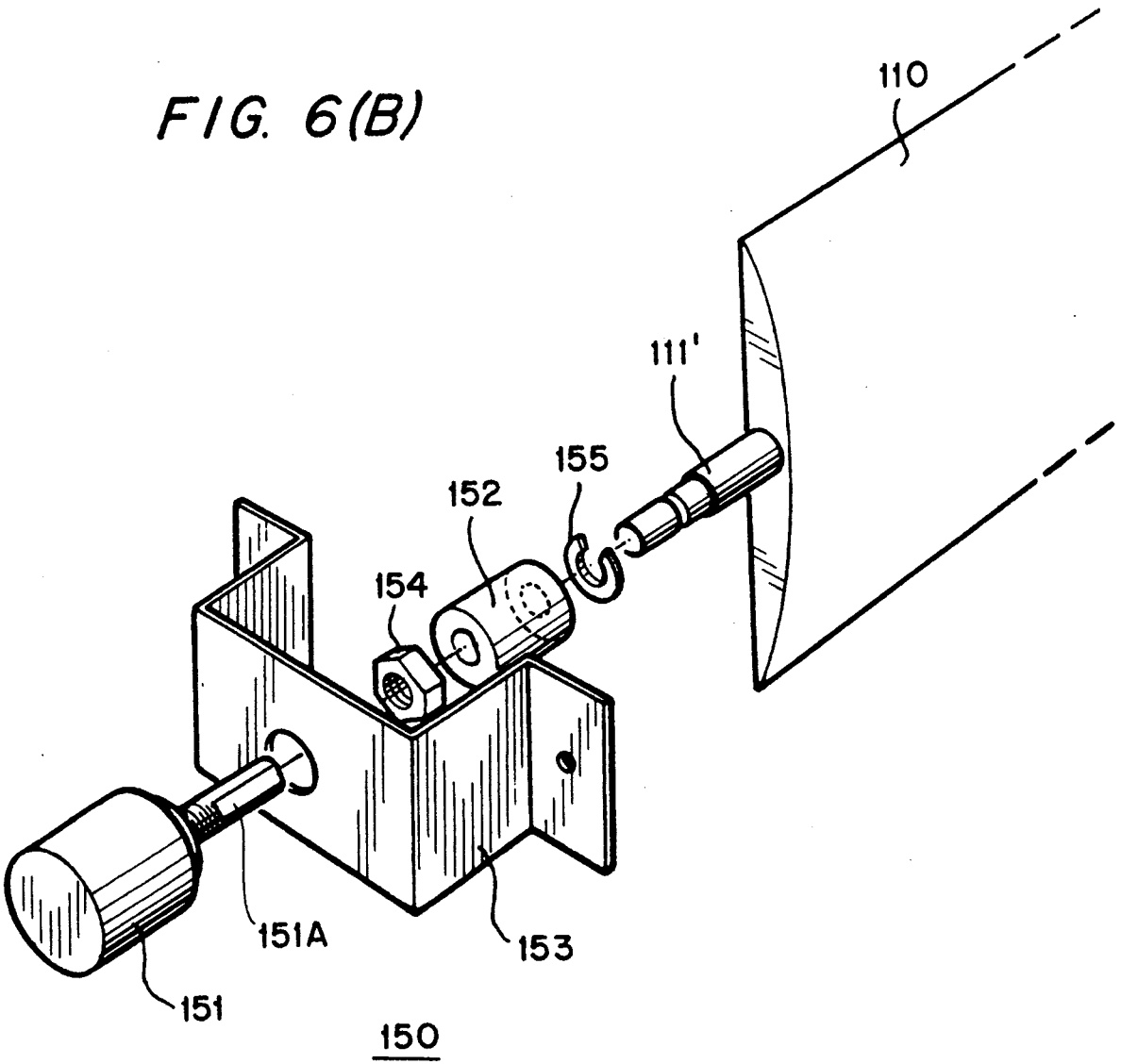

FIG. 5 is a front view showing an air flow direction control apparatus according to the present invention, and FIGS. 6 (A) and (B) are exploded perspective views of an air flow direction control apparatus according to the present invention.

Referring to FIGS. 5 and 6, the mechanical configuration of the air flow direction control apparatus comprises a plurality of blades 110, a rotative drive force generating portion 120, a first driving force converting portion 130, a second driving force converting portion 140, and a rotation angle sensing portion 150.

The blades 110 are disposed at equal intervals behind the discharge portion 100 and are secured between two supporting plates 112 and 112' by the shafts 111 and 111' thereof.

The rotative driving force generating portion 120 comprises a bracket 123 secured to the inner side wall of the discharge portion 100, a motor 121 secured to the bracket 123, and a pinion 122 securely attached to the axis of the motor 121.

The first driving force converting portion 130 comprises a track-shaped sliding member 131 which is placed adjacent to the outer wall of the supporting plate 112. The sliding member 131 has two racks, **131*a* and 131*b*, which are formed on the inner and outer surfaces thereof. The outer rack 131*b* is engaged with the pinion 122**.

The second driving force converting portion 140 comprises a plurality of pinions 141, **141*a* and 141*b* which are securely attached to the shaft 111 of a respective blade 110 and engaged with the inner rack 131*a* of the sliding member 131, and first and second washers 142,142*a* and 142*b*; 143,143*a* and 143*b* disposed in the front and back sides of the pinions 141, 141*a* and 141*b* respectively to prevent the dislocation of the pinions 141, 141*a* and 141*b* out of the shaft 111**.

The rotation angle sensing portion 150 is disposed to the outside of the supporting plate 112'. The rotation angle sensing portion 150 comprises a bracket 153 secured to the outer wall of the supporting plate 112' to support the main parts of the rotation angle sensing portion 150, a coupling 152 half of which is securely attached to the shaft 111', which extends through the supporting plate 112'. A shaft **151*a* of a variable resistor 151 is securely attached to the other half of the coupling 152. Furthermore, a washer 155 is inserted into the supporting plate 112' and a nut 154** is secured to the thread screw portion of the shaft.

Figure 7:
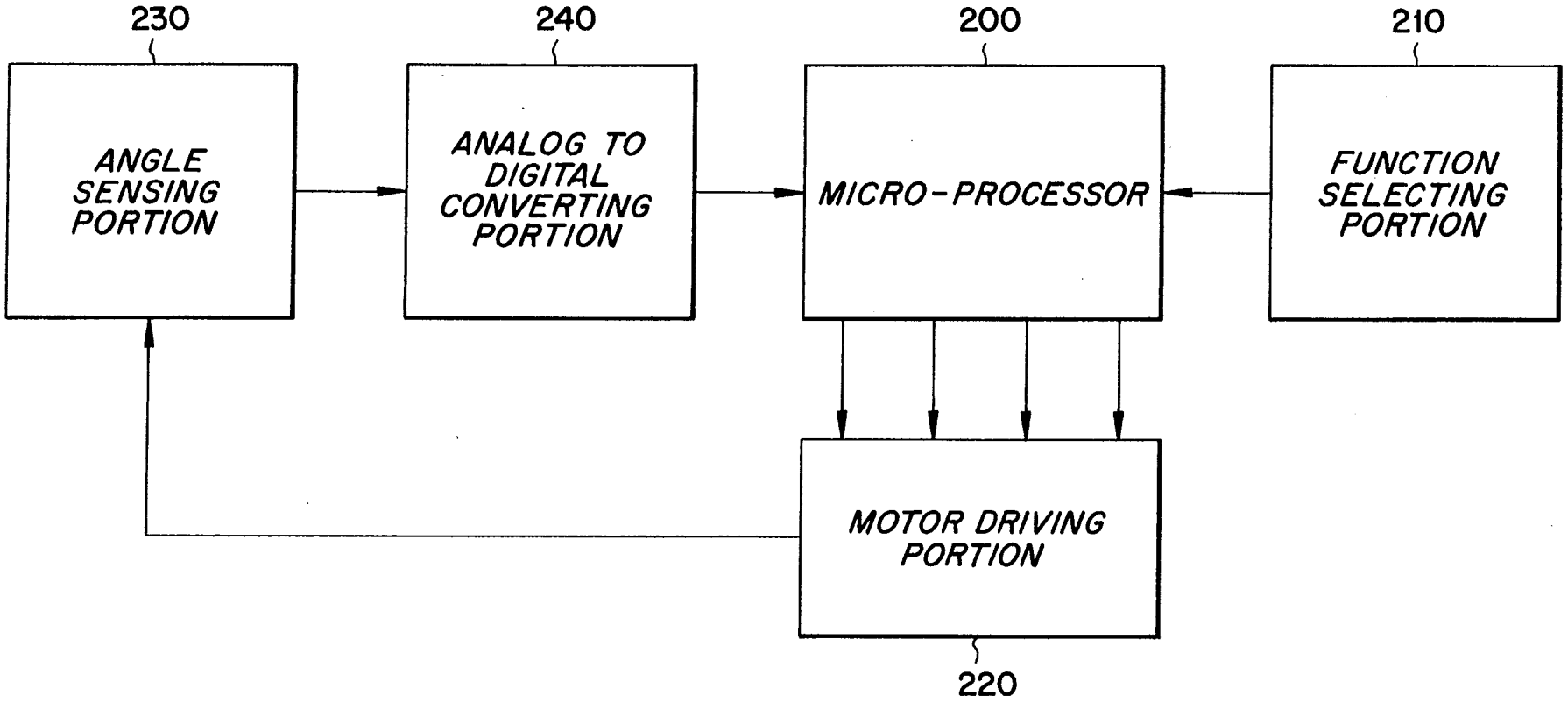
FIG. 7 is a block diagram schematically showing the electrical configuration of an air flow direction control apparatus according to the present invention.
Figure 8:
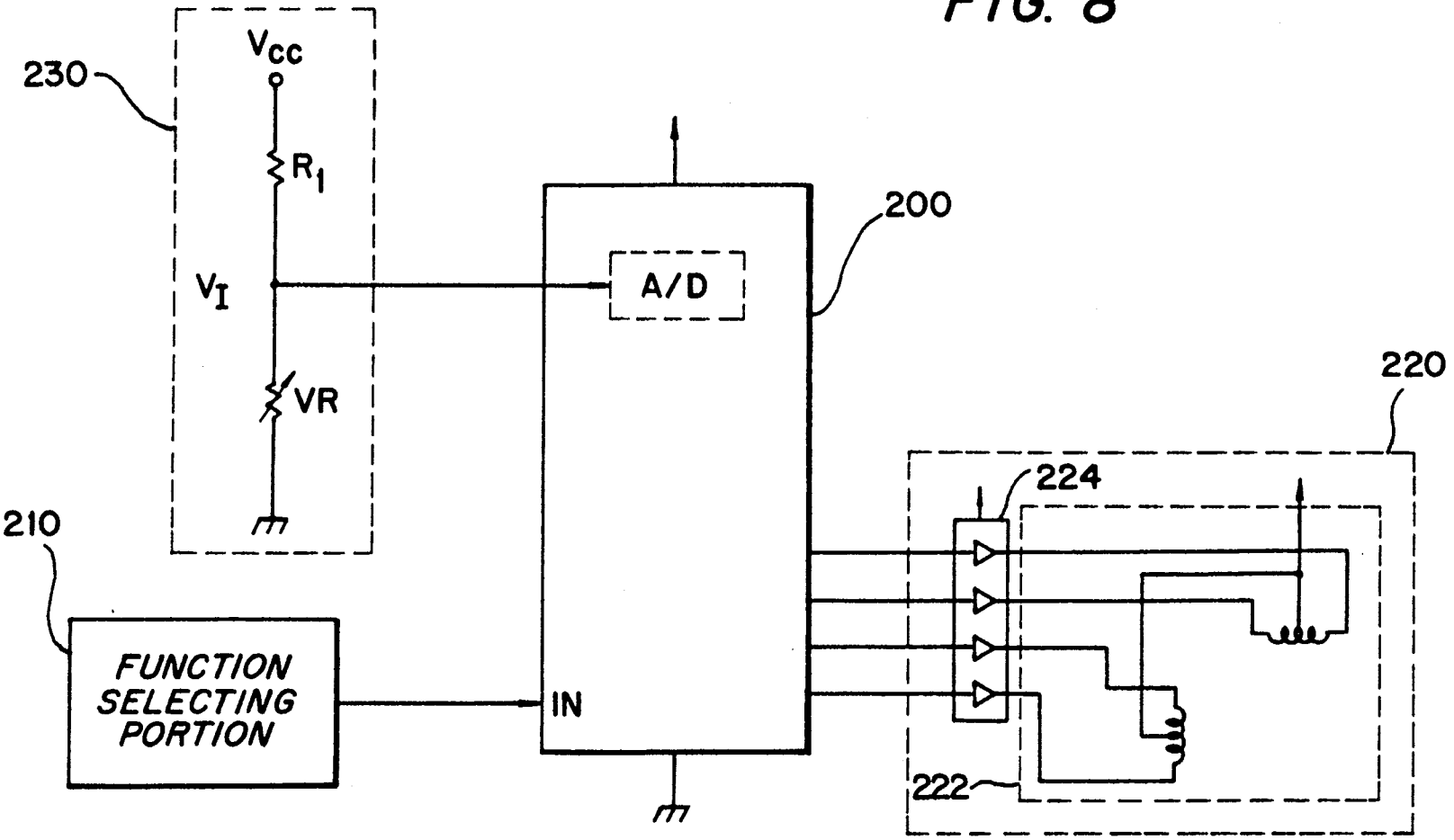
FIG. 8 is a detailed circuit diagram showing the electrical configuration of an air flow direction control apparatus according to the present invention; and, FIG. 9 is a flow chart explaining the air flow direction control method according to the present invention.

FIG. 7 is a block-diagram schematically showing the electrical configuration of an air flow direction control apparatus of the present invention, and FIG. 8 is a detailed circuit diagram showing the electrical configuration of an air flow direction control apparatus of the present invention.

Referring to FIGS. 7 and 8, the electrical configuration of the air flow direction control apparatus comprises a microprocessor 200 as a control portion for controlling the entire operation of the air conditioner, an angle sensing portion 230 for sensing the rotation angle of the blades 110, an A/D (analog to digital) converting portion 240 for converting the analog signal provided by the angle sensing portion 230 to a digital signal suitable for the microprocessor 200, and a motor driving portion 220 for rotating the blade 110. Reference numeral 210 denotes a function selecting portion, by which the user may select, for example, the "AUTO", MANUAL" or the like operation mode. The function of the A/D converting portion 240, shown in FIG. 7, may be embodied in the microprocessor 200 as shown in FIG. 8.

The angle sensing portion 230 comprises a voltage dividing resistor R1 and the variable resister 151 shown in FIGS. 5 and 6, connected in series to the power supply source (Vcc). The junction of the resister R1 and the variable resister 151 is connected to the input terminal of the A/D converting portion 240. As the resistance of the variable resister 151 is varied in proportion to the rotation of the blades 110, the voltage ($VI=VR\times Vcc/(R1+VR)$) at the junction is also varied, where VR is the voltage across the resister 151. The analog voltage signal thus varied is converted to a corresponding digital signal through the A/D converting portion 240 and is then transmitted to the microprocessor 200. The microprocessor 200 then determines the rotation angle of the blades 110 based on the signal from the A/D converting portion 240.

The motor driving portion 220 comprises the motor 121 shown in FIGS. 5 and 6, and a buffer circuit 224. A stepping motor which can precisely control the rotation angle may be preferably used as the motor 121.

The microprocessor 200 calculates the amount of air to be treated based on the room temperature, for example, when the "AUTO" operation mode is selected, and it then operates the cooled (or heated) air generating means, not shown. When the "AUTO" operation mode is selected, the microprocessor 200 may also control the discharge direction (or amount) of the air treated, that is, the rotation angle of the blades 110, in accordance with the operating program.

On the other hand, when the "MANUAL" operation mode is selected, the microprocessor 200 operates the cool (or hot) air generating portion according to the stage selected among, for example, "HIGH", "MEDIUM", and "LOW" stages. When the "MANUAL" operation mode is selected, the user may optionally rotate the blades 110 by the function selecting portion 210 or by directly applying an external force to the blades 110.

Hereinafter, the operation of the air flow direction control apparatus will be described in detail with reference to FIG. 9 and the afore-mentioned drawings.

Figure 9:
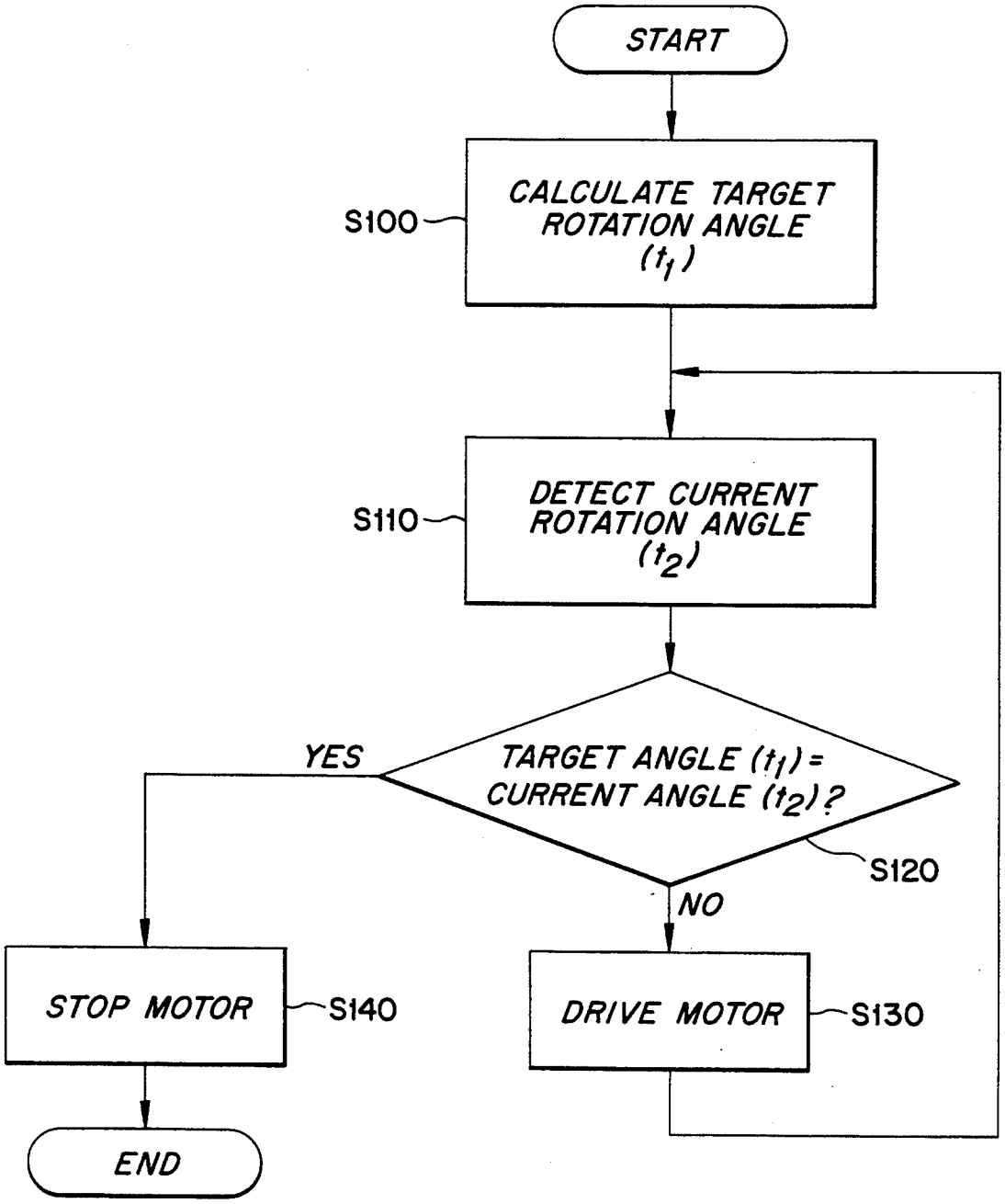

FIG. 9 is a flow chart explaining an air flow direction control method according to the present invention.

For the convenience of this description, it is assumed that the blades 110 are positioned in the closed state as shown by the solid line in FIG. 5 when the power supply source is not supplied to the air conditioner.

When the power supply source is supplied to the air conditioner and the air conditioner is in the cooling or heating operation, the microprocessor 200 calculates a target rotation angle (t1) for the blades 110 according to the room temperature (when in the "AUTO" operation mode), or it receives a target rotation angle (t1) for the blades 110 from the function selecting portion 210 (when in the "MANUAL" operation mode) in step S100.

In step S110, the current rotation angle (t2) of the blades 110 is detected.

In step S120, it is determined whether or not the target rotation angle (t1) is the same as the current rotation angle (t2) detected in step S110. When the target rotation angle (t1) is not the same as the current rotation angle (t2) in the comparison results of step S120, the program proceeds to step S130 and the motor 121 is then activated by the control signal from the microprocessor 200. As the motor 121 is activated, the outer rack **131*b* of the sliding member 131, which is engaged with the pinion 122, begins to move upward as shown by the dash and dotted line in FIG. 6. As the sliding member 131 begins to move upward, the pinions 141, 141*a* and 141*b* engaged with the inner rack 131*a* of the sliding member 131 and securely attached to the shaft 111 of the blades 110 are rotated, thereby rotating the blades 110** to the target rotation angle (t1).

As the blades 110 are rotated, the shaft of the variable resistor 151, which is secure attached to the shaft 111' of one of the blades 110 by means of the coupling 152, is also rotated in synchronism with the rotation of the blades 110, whereby its resistance is varied.

In the course of repeatedly performing the steps S110 through S130, when the current rotation angle (t2) becomes the same as the target rotation angle (t1) in step S120, the program advances to step S140 and microprocessor 200 then stops the motor 121. According to the method described above, the blades 110 are thus exactly positioned at the target rotation angle (t1).

On the other hand, when the rotation angle of the blades 110 is changed by an undesirable external force and without a command for changing the rotation angle of the blades 110 from the state that the blade 110 is exactly positioned at the target rotation angle (t1), the shaft of the variable resister 151 is also rotated. Accordingly, the current rotation angle (t2) becomes different from the target rotation angle (t1), which is immediately detected by the microprocessor 200. Next, the microprocessor 200 controls the motor 121 to be activated by repeatedly performing steps S110 through S130 described above so that the blades 110 may be positioned to the target rotation angle (t1).

In the control method described above, the microprocessor 200 preliminarily stores the data related to each step angle of the stepping motor 121 with the resistance of the variable resistor 151, and calculates the target rotation angle (t1) on the basis of the stored data.

However, the user may alternatively vary the rotation angle of the blades 110 by directly applying a force to the blades 110, thereby overriding the method described above.

The air direction control apparatus and method according to the present invention may also be applied to a fan heater, or the like.

We claim:

1. Apparatus for directing an air flow, comprising:

a frame defining an air flow passage;

a plurality of blades mounted to said frame across said passage, said blades mounted for rotation between passage-opening and passage-closing positions and to intermediate positions therebetween;

a blade-rotating motor connected to said blades, said motor including a drive shaft and a first pinion affixed to said shaft;

a blade-position sensor;

a controller connected to said blade rotating motor and said blade-position sensor for supplying a signal to said motor for rotating said blades to a desired position;

a first force converter for converting a rotary force of said motor to a linear force, said first force converter comprising a linearly slidable member having first and second racks disposed on opposing sides thereof, said first rack connected to said first pinion to be driven thereby; and a second force converter for converting said linear force to a rotary force applied to said blade members, said second force converter comprising second pinions operably connected to said second rack and respective ones of said blades.

2. Apparatus according to claim 1, wherein said blade position sensor comprises a variable resistor whose resistance is varied in proportion to the extent of rotation of said blade members.

3. A method for controlling air flow through an air flow passage by a plurality of rotatably adjustable blades extending across said passage and being rotatable by a motor between passage-opening and passage-closing positions and intermediate positions therebetween, said method comprising the steps of sensing a rotary position of said blades, comparing said sensed rotary position with a selected rotary position and actuating a motor for moving said blades to said selected position when a deviation exists between said sensed position and said selected position, to enable said blades to be returned to said selected position after being displaced therefrom by a force applied independent of said motor.

4. A method according to claim 3, wherein said sensing step comprises varying an electrical resistance in response to rotation of said blades.

* * * * *